US008026653B2

(12) United States Patent
Oishi et al.

(10) Patent No.: US 8,026,653 B2
(45) Date of Patent: Sep. 27, 2011

(54) DISPLAY DEVICE AND OPTICAL FILTER

(75) Inventors: Toshiharu Oishi, Kawasaki (JP); Minoru Higuchi, Kawasaki (JP); Takahide Fujimoto, Kawasaki (JP); Akihiko Horita, Kawasaki (JP); Ryusuke Fukushima, Kawasaki (JP); Eishi Mizobata, Kawasaki (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 188 days.

(21) Appl. No.: 12/305,566

(22) PCT Filed: Jun. 20, 2007

(86) PCT No.: PCT/JP2007/062415

§ 371 (c)(1), (2), (4) Date: Jun. 3, 2009

(87) PCT Pub. No.: WO2007/148721

PCT Pub. Date: Dec. 27, 2007

(65) Prior Publication Data

US 2010/0067115 A1 Mar. 18, 2010

(30) Foreign Application Priority Data

Jun. 22, 2006 (WO) ..... PCT/JP2006/312933
Mar. 30, 2007 (WO) ..... PCT/JP2007/057268

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/112; 313/110; 313/582; 313/635

(58) Field of Classification Search ..... 313/112, 313/474, 478, 634, 635, 580, 582, 110, 113
See application file for complete search history.

(56) References Cited

U.S. PATENT DOCUMENTS

| | | | | |
|---|---|---|---|---|
| 5,481,385 | A | 1/1996 | Zimmerman et al. | |
| 2002/0167725 | A1 | 11/2002 | Goto | |
| 2003/0142486 | A1 | 7/2003 | Arakawa et al. | |
| 2005/0231109 | A1 * | 10/2005 | Yoo | 313/582 |
| 2006/0007302 | A1 | 1/2006 | Numata et al. | |
| 2006/0104084 | A1 | 5/2006 | Amemiya et al. | |
| 2006/0145578 | A1 * | 7/2006 | Park et al. | 313/112 |
| 2006/0250064 | A1 * | 11/2006 | Park et al. | 313/112 |

FOREIGN PATENT DOCUMENTS

EP 1 283 106 2/2003

(Continued)

*Primary Examiner* — Joseph L Williams
*Assistant Examiner* — Kevin Quarterman
(74) *Attorney, Agent, or Firm* — Drinker Biddle & Reath LLP

(57) ABSTRACT

A display device provided with a screen, comprising: an optical filter having a blind sheet that comprises a plurality of semitranslucent layers having translucence arranged side-by-side extending in a horizontal direction and having a predetermined thickness in a vertical direction, and a plurality of transparent layers which are disposed between the semitranslucent layers and which are of a higher translucency than that of the semitranslucent layers and of a greater thickness than the thickness of the semitranslucent layers; and an adhesive member for sticking the optical filter to the screen, wherein the ratio of the transmittance of a limit angle of the screen with respect to the transmittance of the optical filter at the center of the screen is at least 0.10 and not more than 0.50.

10 Claims, 8 Drawing Sheets

FOREIGN PATENT DOCUMENTS

| | | |
|---|---|---|
| JP | 57-143083 | 9/1982 |
| JP | 05-297206 | 11/1993 |
| JP | 6-504627 | 5/1994 |
| JP | 09-127309 | 5/1997 |
| JP | 2000-029406 | 1/2000 |
| JP | 2004-206076 | 7/2004 |
| JP | 2004-295045 | 10/2004 |
| WO | 2005/116698 | 12/2005 |

* cited by examiner

LIMIT ANGLE

θ = CRITICAL ANGLE $\phi > \theta$

DISPLAY DEVICE AND OPTICAL FILTER

TECHNICAL FIELD

The present invention relates to a display device such as a flat display and an optical filter.

BACKGROUND ART

Flat display devices comprise a thin planar display panel such as a plasma display panel or a field emission display panel or the like.

For example, a plasma display panel has a structure in which a pair of a front substrate and a rear substrate are disposed facing one another in parallel and the periphery of a discharge space between the front and rear substrates is sealed.

A reflective-type AC-type plasma display panel has a constitution in which a plurality of row electrode pairs that perform surface discharge (display discharge) on the inner face of the front substrate and a dielectric layer that covers the row electrode pairs are formed, in which, on the inner face side of the rear substrate facing the front substrate, column electrodes that are disposed in a direction orthogonal to the row electrode pairs and perform selective discharge with respect to one row electrode of the row electrode pairs and a column electrode protection layer that covers the column electrodes are formed, and in which a barrier wall that divides the discharge space into each of the discharge cells is formed between the front and rear substrates, phosphor layers color-divided into three primary colors red, green, and blue respectively being formed side by side in that order in each of the discharge cells.

In the conventional flat display device mentioned above, a front filter (panel protection plate) disposed in front of the flat display panel is constituted by sticking an external light anti-reflection sheet and a film that blocks electromagnetic waves and infrared waves generated by the flat display panel onto a glass substrate.

In addition, a technology where, in an LED display device having a plurality of LED elements, reflection by the LED elements is prevented by sticking a light-blocking louver film to the surface of the LED elements and irradiating the LED elements with external light in a direction intersecting the thickness direction is known. Here, the louver film is stuck to the surface of the LED elements by means of an adhesive material (See Patent Document 1).

In addition, a plasma display panel resin sheet capable of transmitting rectilinear light whereon transparent areas and dark-colored areas are formed alternately in the sheet surface direction is known. The transparent areas and dark-colored areas are each orthogonal or oblique with respect to the sheet surface and inclined in the form of layers. A technology that stacks a plasma display panel resin sheet, a bandpass filter and an electromagnetic wave shield layer is also known (See Patent Document 2).

In addition, in the case of a microlens array sheet in which a first material layer and a second material layer which has a smaller refractive index than that of the first material layer are sandwiched between two parallel planes and a micro unit lens that functions as a lens due to the fact that the interface between the first and second material layers forms a concave and/or convex shape is disposed in a planar state, a microlens array sheet formed by mounting at least a convex apex area of the first material layer of the micro unit lens on a transparent substrate via a pressure-sensitive adhesive or bonding adhesive such as an acrylic resin and, if necessary, via a spacer, as well as a liquid-crystal display that employs the microlens array sheet are also known (See Patent Document 3).

In addition, a reduction in the number of parts and simplification of the support structure of the flat display panel as well as a lower cost product are achieved by sticking a plastic optical filter integrally to the screen of the flat display panel instead of providing a protective panel made of a conventional glass substrate separately from the flat display panel (See Patent Document 4).

Patent Document 1: Japanese Patent Application Laid Open No. 2000-29406

Patent Document 2: Japanese Patent Application Laid Open No. 2004-295045

Patent Document 3: Japanese Patent Application Laid Open No. H09-127309

Patent Document 4: Japanese Patent Application Laid Open No. 2004-206076

The external light of an indoor light or the like is generally reflected by the screen of a display device that displays an image such as a flat display panel or the like, whereby the problem of black luminance sharpness and deterioration in the contrast on the screen is generated.

In the prior art disclosed by the Patent Documents mentioned above, a sheet or film having a light-absorbing or light-blocking horizontal louver structure comprising a black or dark-colored material is adopted in order to improve the contrast and prevent external light. However, in cases where the viewer views the screen obliquely from above or at a position above the front of the screen, that is, in cases where the viewer views the screen at an inclination to the horizontal line of sight, there is a viewing angle problem that the screen be hardly seen or inconvenient for the viewer.

For example, with a display panel equipped with a sheet that has a black horizontal louver structure, in cases where the screen is viewed with a slope of 45 degrees as shown in FIG. 14, a plurality of louvers cast a shadow and the lower half of the screen cannot be seen. The upper half of the screen cannot be seen in cases where the screen is viewed at an angle of elevation.

DISCLOSURE OF THE INVENTION

Problem to be Solved by the Invention

Therefore, the present invention cites, by way of example, the provision of a display device capable of preventing the reflection of the external light of an indoor light or the like and of securing a viewing angle in the vertical direction of the screen.

Means for Solving the Problem

The display device of the present invention is a display device having a screen, comprising an optical filter having a blind sheet that comprises a plurality of semitranslucent layers having translucence arranged side-by-side extending in a horizontal direction and having predetermined thickness in a vertical direction, and a plurality of transparent layers which are disposed between the semitranslucent layers, and which are of a higher translucency than that of the semitranslucent layers and of a greater thickness than the thickness of the semitranslucent layers; and an adhesive member for sticking the optical filter to the screen, wherein the ratio of the transmittance of a limit angle of the screen with respect to the transmittance of the optical filter at the center of the screen is at least 0.10 and not more than 0.50.

Furthermore, the optical filter of the present invention is an optical filter that is disposed at a front face of a display face of a display device and parallel to the display face, comprising a blind sheet that comprises a plurality of semitranslucent layers having translucence arranged side-by-side extending in a horizontal direction and having a predetermined thickness in a vertical direction and a plurality of transparent layers which are disposed between the semitranslucent layers, and which are of a higher translucency than that of the semitranslucent layers and of a greater thickness than the thickness of the semitranslucent layers, wherein the ratio of the transmittance at a screen center limit angle with respect to the transmittance of a screen center normal is at least 0.10 and not more than 0.50.

EXPLANATION OF REFERENCE NUMERALS

Figure 1:
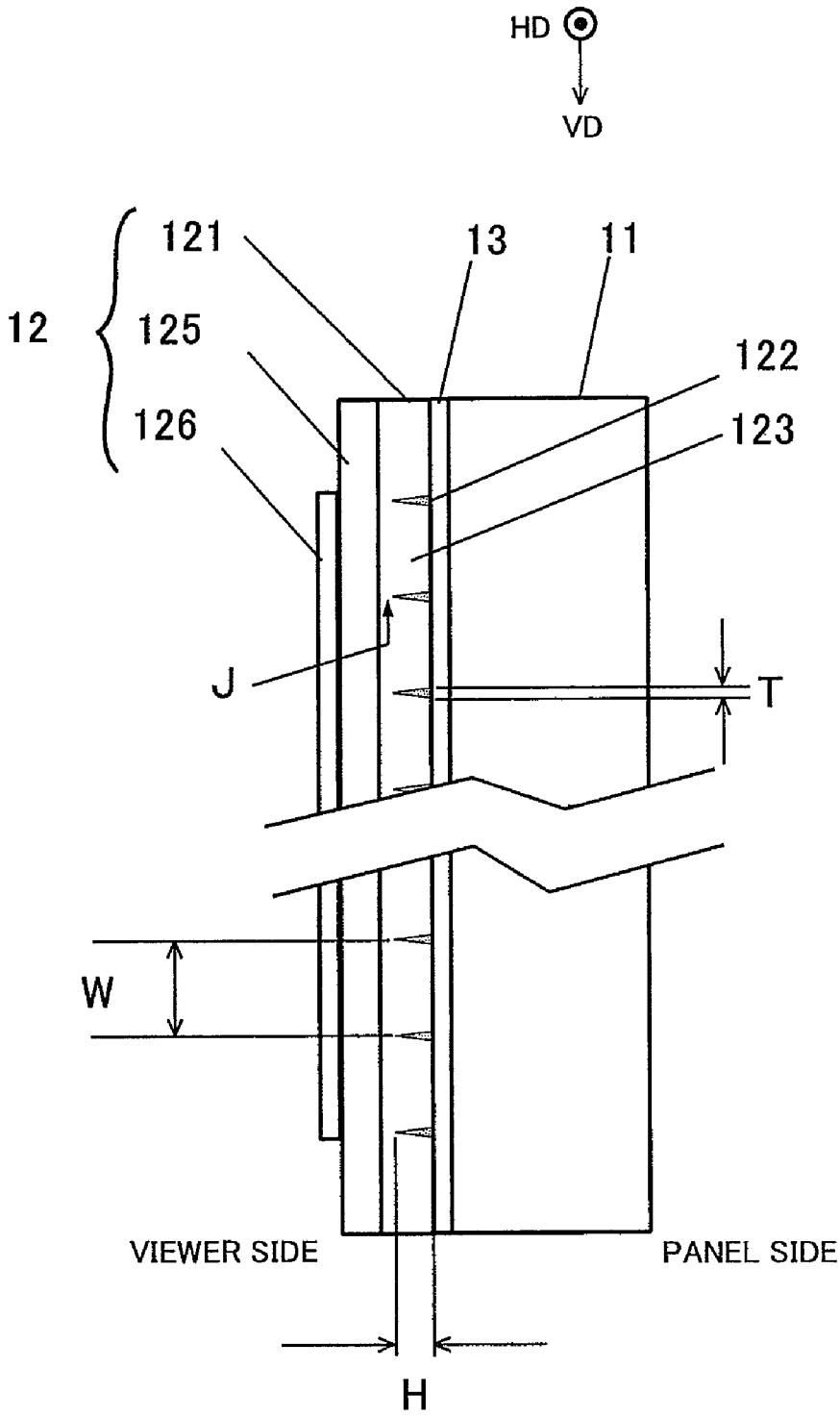
FIG. 1 is a schematic partial lateral cross-sectional view of the constitution of a flat display device of the embodiment of the present invention.

12 Optical filter
13 Adhesive member
121 Blind sheet
122 Semitranslucent layer
123 Translucent layer
125 Electromagnetic wave blocking layer
126 Pigment layer

BEST MODE FOR CARRYING OUT THE INVENTION

A display device of an embodiment of the present invention will be described hereinbelow with reference to the drawings.

FIG. 1 is a partial lateral cross-sectional view of an embodiment of the flat display device of the present invention. The flat display device is constituted by using a translucent adhesive member 13 to stick an optical filter 12 to a flat screen of a flat display device 11.

Figure 2:
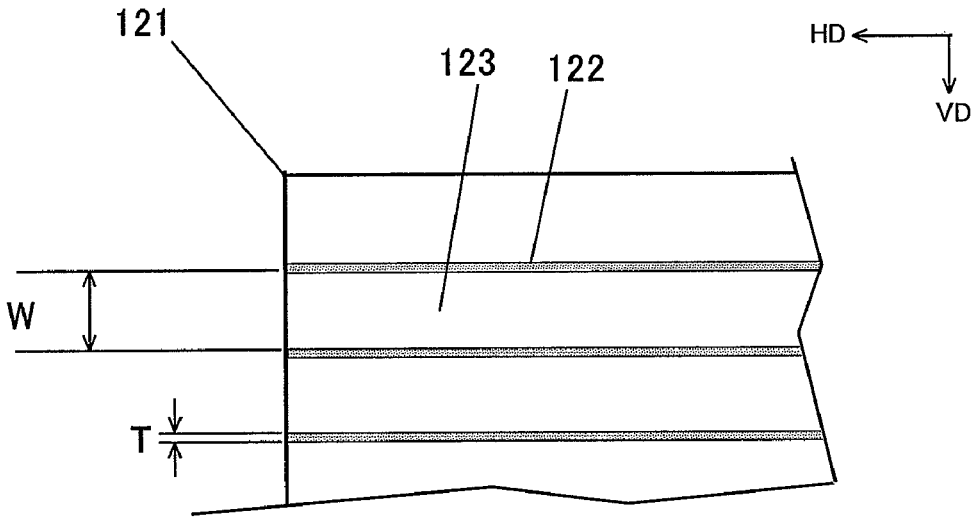
FIG. 2 is a schematic partial front view of a blind sheet of the flat display device of the embodiment of the present invention.

The optical filter 12 comprises a blind sheet 121. The blind sheet 121 comprises a plurality of semitranslucent layers 122 which are slats that extend in a horizontal direction HD and have a predetermined thickness T in a vertical direction VD and a plurality of transparent layers 123 that are disposed between the semitranslucent layers 122 and have a thickness W in the vertical direction that is greater than the thickness T of the semitranslucent layers, as shown in the schematic partial front view of FIG. 2.

The semitranslucent layer 122 comprises a mixture of an ultraviolet-cured resin and a light-absorbing material, for example, and the transparent layer 123 comprises a transparent ultraviolet-cured resin. The semitranslucent layer 122 can be cyclically disposed at equal intervals.

The semitranslucent layer 122 can be formed by being embedded in the transparent ultraviolet-cured resin of the transparent layer 123 for termination on the viewer's side VIEWERSIDE, that is, by providing a linking portion J. As a result, the strength of the blind sheet 121 can be increased to exceed that of a case where the semitranslucent layer 122 penetrates the blind sheet 121. The general external light on the screen from above the viewer is limited by the semitranslucent layer 122 and unnecessary external light reflection can be reduced by this external light limitation.

The optical filter 12 has a structure in which a color-tone correcting layer 126 is laminated on an electromagnetic wave blocking layer 125 (electromagnetic wave shield mesh film or the like) and the blind sheet 121 is also laminated on the underside of the electromagnetic wave blocking layer 125. The color-tone correcting layer 126, for example, is a single layer such as an infrared wave absorption layer (NIR film), color tone correction layer, an Ne cut film, or an antireflection layer (AR film) or a stacked body of the aforementioned layers/film and possesses various optical functions. The Moire intensity can be attenuated by providing the color-tone correcting layer 126 in front of (on the viewer side of) the blind sheet 121.

By forming the height H of the horizontal stripes of the semitranslucent layer 122 (the distance from one surface to the free end) and the thickness W (vertical direction) of the transparent layer 123 to limit the viewing angle to an angle of thirty degrees from the horizontal, external light from above (or below) can be limited.

In the embodiment mentioned above, the cross-section of the blind sheet 121 in the vertical direction of the semitranslucent layer 122 is an isosceles triangle with a taper in a direction facing the viewer (the direction of the normal from the screen). However, light emission from the display panel can be favorably supplied to the viewer because the thickness of the taper, that is, the semitranslucent layer decreases with increased separation from the display panel screen side PANELSIDE.

Figure 3:
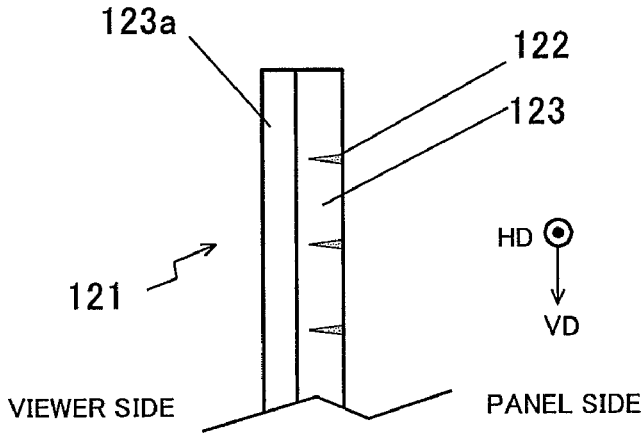
FIG. 3 is a schematic partial lateral cross-sectional view of the blind sheet of the flat display device of another embodiment of the present invention.

Furthermore, as shown in FIG. 3, the blind sheet 121 can be a stacked body with a thickness of 250 μm or more (in the normal direction from the screen) formed by stacking the semitranslucent layer 122 and transparent layer 123 on a transparent PET film 123*a* that is 125 μm thick, for example, whereby the impact elimination function can be improved (the PET film is on the viewer side).

A display-panel impact elimination function can be added by establishing the shore hardness of the ultraviolet-cured resin material of the stacked body of the transparent layer 123 at 20 to 50°. Further, in cases where the transparent layer is made soft by lowering the shore hardness, hollows caused by the planarity of the sheet and forces from the outside and so forth are sometimes a problem. Hence, such a problem of keeping the impact elimination function as is can be resolved by retaining a function to harden the semitranslucent layer 122 and retain the sheet shape while the transparent layer 123 remains soft. Accordingly, the shore hardness of the transparent layer and the semitranslucent layer is suitably governed by the relationship transparent layer=the semitranslucent layer. The blind sheet impact elimination function will be described subsequently.

The present invention investigated raising the transmittance of the semitranslucent layer which has a lower translucency than that of the transparent layer in order to secure a vertical screen viewing angle.

When the transmittance of the semitranslucent layer is zero, that is, in the case of a conventional light-blocking horizontal louver-shaped structure, the vertical screen viewing angle decreases in comparison with a case without this structure, as mentioned earlier. Furthermore, even when the transmittance of the light-blocking horizontal louver is not zero, when the transmittance is low, a drop in luminance occurs, which makes viewing difficult. The present inventor therefore contrived the present invention by introducing the concept of a screen limit angle to the display panel design.

When the transmittance of the semitranslucent layer is taken to be 0%, the "screen limit angle" means an angle with which the semitranslucent layer casts a shadow and the screen is hard to view from another visibility distance point on the screen center normal (zero degrees).

Figure 4:
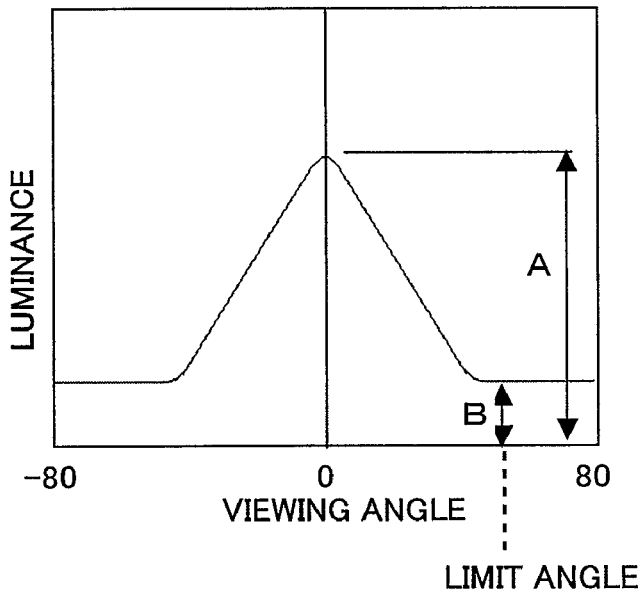
FIG. 4 is a graph showing the luminance characteristic with respect to the viewing angle of the blind sheet of the flat display device of the embodiment of the present invention.

More specifically, as shown in FIG. 4, an evaluation was performed by means of the ratio between a transmittance A with a viewing angle of 0 degrees and a transmittance B where the viewing angle is the limit angle (B/A, called the "transmission ratio" hereinbelow), whereby the preferred transmission ratio was found. The luminance equivalent to the transmittance was measured and appears at this level on the vertical axis in FIG. 4.

If the transmission ratio is 1.0, that is, the transmittance of the semitranslucent layer is equal to the transmittance of the transparent layer, the effect of the blind sheet is eliminated. This is because the role of the blind sheet is fulfilled by the semitranslucent layer which reduces the influence of external light by limiting the external light.

Figure 5:
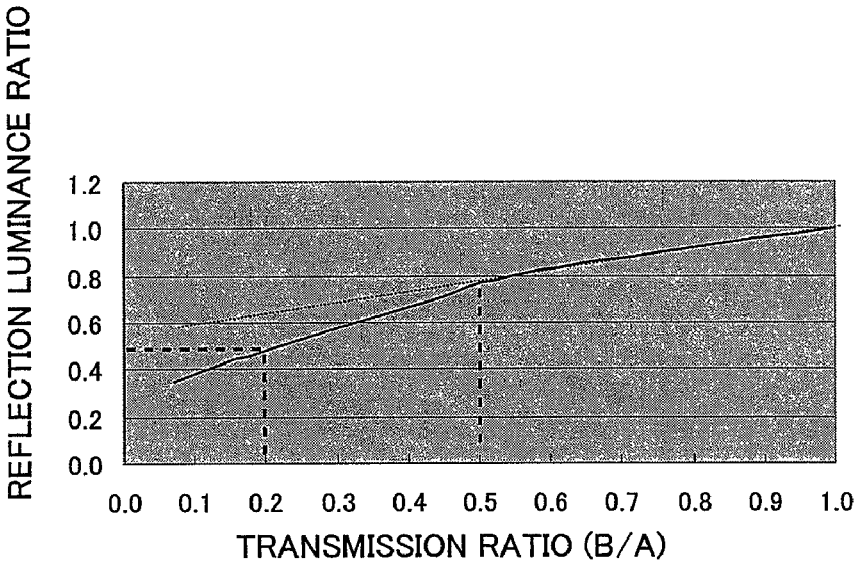
FIG. 5 is a graph showing a characteristic of the reflection luminance ratio with respect to the transmission ratio of the blind sheet of the flat display device of the embodiment of the present invention.

FIG. 5 shows the variation in the external light reflectance according to the transmission ratio (B/A) of the semitranslucent layer (reflection luminance ratio).

As is clear from FIG. 5, if the transmission ratio is 1.0, the reflection luminance ratio is 1.0 and the effect of the blind sheet is eliminated. However, even when the transmission ratio is zero, this does not mean that the reflection luminance ratio is zero. This is because external light is reflected not only by the panel but also by the layers constituting the filter.

Bright room contrast can be improved by a reduction in external light reflection which is the effect afforded by the blind sheet. Bright room contrast is defined as follows.

The bright room contrast=(white luminance+product reflectance×external light)/(black luminance+product reflectance×external light)

Product reflectance corresponds to the external light reflectance mentioned earlier.

In a bright room, the denominator of the bright room contrast (product reflectance×external light) is dominant and the numerator of the bright room contrast (the white luminance) is dominant. Hence, if the reflection luminance ratio is 0.5, the bright room contrast is close to a multiple of two. Accordingly, reducing the transmission ratio as much as possible improves the bright room contrast.

However, there is a problem that, when the transmission ratio is reduced, an increase in the vertical viewing angle (here, the angle of elevation or slope) produces a reduction in the screen luminance.

Therefore, a subjective evaluation by a plurality of viewers was carried out by sticking a blind sheet on a plasma display panel and changing the transmission ratio and viewing angle.

The evaluation method involved a relative scoring evaluation of picture quality by the viewers in cases where an optional vertical viewing angle with respect to the center of the screen (a viewing angle of zero degrees) was changed to 30 degrees, 45 degrees, and 60 degrees in a bright (200 to 300 lux) environment. The luminance variation amount was mainly evaluated. The results of the evaluation are shown in Table 1.

TABLE 1

| | | Transmission ratio | | | | | | |
|---|---|---|---|---|---|---|---|---|
| | | 0.08 | 0.10 | 0.12 | 0.14 | 0.16 | 0.18 | 0.20 |
| Viewing angle (degrees) | 0 | 5 | 5 | 5 | 5 | 5 | 5 | 5 |
| | 30 | 2 | 3 | 4 | 4 | 5 | 5 | 5 |
| | 45 | 2 | 2 | 3 | 3 | 4 | 5 | 5 |
| | 60 | 2 | 2 | 2 | 2 | 3 | 4 | 4 |

(General example)
Scoring content
1: not visible
2: large difference from center, hindrance
3: difference from center worrisome but not a hindrance
4: difference from center can be seen but not worrisome
5: difference from center cannot be seen
* Differences were evaluated by taking, as a reference, an evaluation without a blind sheet with a transmission ratio of 1.00.

Upon evaluating the transmission ratio of the semitranslucent layer, it was found from the results above that the transmission ratio is preferably from 0.10 to 0.50. Accordingly, the ratio of the transmittance of the screen limit angle with respect to the transmittance of the optical filter at the center of the screen is preferably from 0.10 to 0.50.

(1) In cases where viewing with the viewer sitting down is considered, the angle of elevation and slope are no more than 20 degrees. Furthermore, in cases where viewing with the viewer standing is considered, the angle of elevation and slope are no more than 30 degrees. Viewings with the viewer sitting and standing were therefore considered and, with the angle of elevation and slope at no more than 30 degrees, the transmission ratio was 0.1 or more under the condition where there were three or more subjective evaluations, and the transmission ratio was 0.12 or more under the condition where there were four or more subjective evaluations.

(2) In FIG. 5, when the reflection luminance ratio is no more than 0.8, that is, when the bright contrast improves by 20% or more, the viewer can generally be given the impression that the image is quite clear. In addition, when the reflection luminance ratio is no more than 0.5, that is, when the bright contrast is a multiple of two or more, the viewer can be given the impression that the image is bright and clear.

From the results of (1) and (2) mentioned above, it can be seen that at least one of (I) to (IV) below is preferable for the specifications of the blind sheet in a case where viewing is performed under normal viewing conditions, that is, sitting or standing at a viewing distance recommended by NHK (Japan Broadcasting Corporation) described subsequently.

(I) Under the condition where the bright contrast-enhancing effect of the blind sheet is felt and there are three or more subjective evaluations of the luminance variation according to the angle of elevation of the blind sheet, the ratio of the transmittance at the screen limit angle with respect to the transmittance of the blind sheet at the center of the screen is from 0.10 to 0.50.

(II) Under the condition where the bright contrast-enhancing effect of the blind sheet is clearly felt and there are three or more subjective evaluations of the luminance variation according to the angle of elevation of the blind sheet, the ratio of the transmittance at the screen limit angle with respect to the transmittance of the blind sheet at the center of the screen is from 0.10 to 0.20.

(III) Under the condition where the bright contrast-enhancing effect of the blind sheet is felt and there are four or more subjective evaluations of the luminance variation according to the angle of elevation of the blind sheet, the ratio of the transmittance at the screen limit angle with respect to the transmittance of the blind sheet at the center of the screen is from 0.12 to 0.50.

(IV) Under the condition where the bright contrast-enhancing effect of the blind sheet is clearly felt and there are four or more subjective evaluations of the luminance variation according to the angle of elevation of the blind sheet, the ratio of the transmittance at the screen limit angle with respect to the transmittance of the blind sheet at the center of the screen is from 0.12 to 0.20.

In cases where the conditions are adapted to a panel with a screen aspect ratio of 16:9, supposing that the lateral length of the screen is W and the vertical length thereof is H, the viewing distance recommended by NHK (Japan Broadcasting Corporation) is 2.82H to 3.32H and this is therefore taken as the viewing distance. The viewing distance is therefore normally approximately three times the vertical length H of a television screen. Hence, when the height of the viewer's eyes is aligned with the center of a screen of a vertical screen length (height) H and viewing takes place at a viewing distance of 3H from the panel screen, the angle of elevation and slope are both approximately ten degrees. Furthermore, the slope with respect to the lower edge of the panel screen when the line of sight is aligned with the height of the upper edge of the screen is approximately 18 degrees. The ideal viewing position is thought to be in the range of the two examples mentioned above and the angle of elevation and slope are no more than 20 degrees. This represents a case where the viewer sits on a chair. However, when the viewer performs viewing while still standing, the position of the line of sight is 40 to 50 cm higher than the case where the viewer is sitting on a chair.

Therefore, the viewing angle (slope) when viewing the lower edge of the screen from a position 50 cm higher than the upper edge of the panel screen height His, at worst, 31 degrees when H=62 (50 format) and the viewing angle is arctan ((50+62)/186)=31.

The present inventor then investigated the hardness of the blind sheet in order to improve the panel impact elimination function.

A display device which comprises a blind sheet is confronted by the problem of the viewing angle and ghosting due to the louvers or blind and a method of direct adhesion to the display device without the interposition of a layer of air may be considered as a technique for solving this problem.

Therefore, in cases where direct adhesion to the screen is performed, problems such as damage to the display device screen caused by an external force arise.

The present inventor therefore contrived a low cost technique for solving these problems by means of a simple format without adding to the constitution. The present inventor disposed a 0.2 mm thick silicon resin film, to the upper face of which an acceleration sensor was fixed, on the underside of a 2 mm thick glass substrate that is horizontally secured, and placed a test filter atop the silicon resin film. Steel balls of 500 grams were dropped onto the filter from a height of 100 cm and the relative value when the impact value at impact was measured by the acceleration sensor was measured. The test filter comprises the color-tone correcting layer 126 and the electromagnetic wave blocking layer 125 in FIG. 1 and does not comprise the blind sheet 121.

Table 2 below represents experimental values for the impact value when the shore hardness of a 0.2 mm thick silicon resin film is changed from 20° to 60° and added to a normal film constitution. In a filter that is stuck directly to a display device without the interposition of a layer of air, the experimental values for the impact value are relative impact values when the impact value for a conventional filter excluding silicon resin is "1".

TABLE 2

| Silicon resin film | Relative impact value |
|---|---|
| Shore hardness 60° | 0.42 |
| Shore hardness 50° | 0.39 |
| Shore hardness 30° | 0.29 |
| Shore hardness 20° | 0.24 |

It can be confirmed from the experiment that the impact value is no more than half that of a conventional color filter due to the addition of a resin with a shore hardness of 50°. More effective results can be obtained preferably at 30° or less.

Furthermore, the relationships between the thickness and hardness and the impact force are such that the thickness and impact force are inversely proportional to one another and the hardness and impact force are approximately proportional to one another. Hence, it is thought that a hardness of 50° with a thickness of 0.2 mm is substantially the same as a hardness of 25° with a thickness of 0.1 mm.

Hence, there is an effect when the silicon resin thickness (mm)/shore hardness is 0.004 or more. The silicon resin thickness (mm)/shore hardness is preferably 0.0067 or more (200/30=0.0066).

It is necessary to reduce the thickness of the glass in order to make the PDP panel lighter. The current glass thickness is 2.8 mm but glass which is able to conform to the fabrication process conditions of the current PDP with a thickness of 1.8 mm have already been disclosed. However, since the physical strength is proportional to the square of the glass thickness, the strength of glass 1.8 mm thick is approximately 0.4 times the strength of glass 2.8 mm thick. Hence, in order to adopt glass 1.8 mm thick and obtain strength that is the same as that of glass 2.8 mm thick, the relative impact value of the results of Table 2 must be no more than 0.4.

The present inventor will now consider a constitution in which a blind sheet is disposed in place of the silicon resin of the experiment mentioned above. The role of the impact attenuation is therefore fulfilled by the blind sheet. Hence, the thickness and shore hardness of the blind sheet are investigated.

When the semitranslucent layer (semitransparent layer) does not retain shore hardness of a certain magnitude, the function of the blind sheet cannot be retained. Hence, the shore hardness of the semitranslucent layer is desirably higher than the shore hardness of the transparent layer. However, the proportion of the entire blind sheet volume occupied by the semitranslucent layer is from 10 to 15%. Hence, the effect of the impact attenuation varies greatly according to the shore hardness and thickness of the transparent layer. The effective shore hardness is a weighted average value for the shore hardness of the semitranslucent layer and the shore hardness of the transparent layer. When the following description mentions the shore hardness of the blind sheet, this denotes a weighted average value for the shore hardness of the semitranslucent layer and the shore hardness of the transparent layer.

Figure 6:
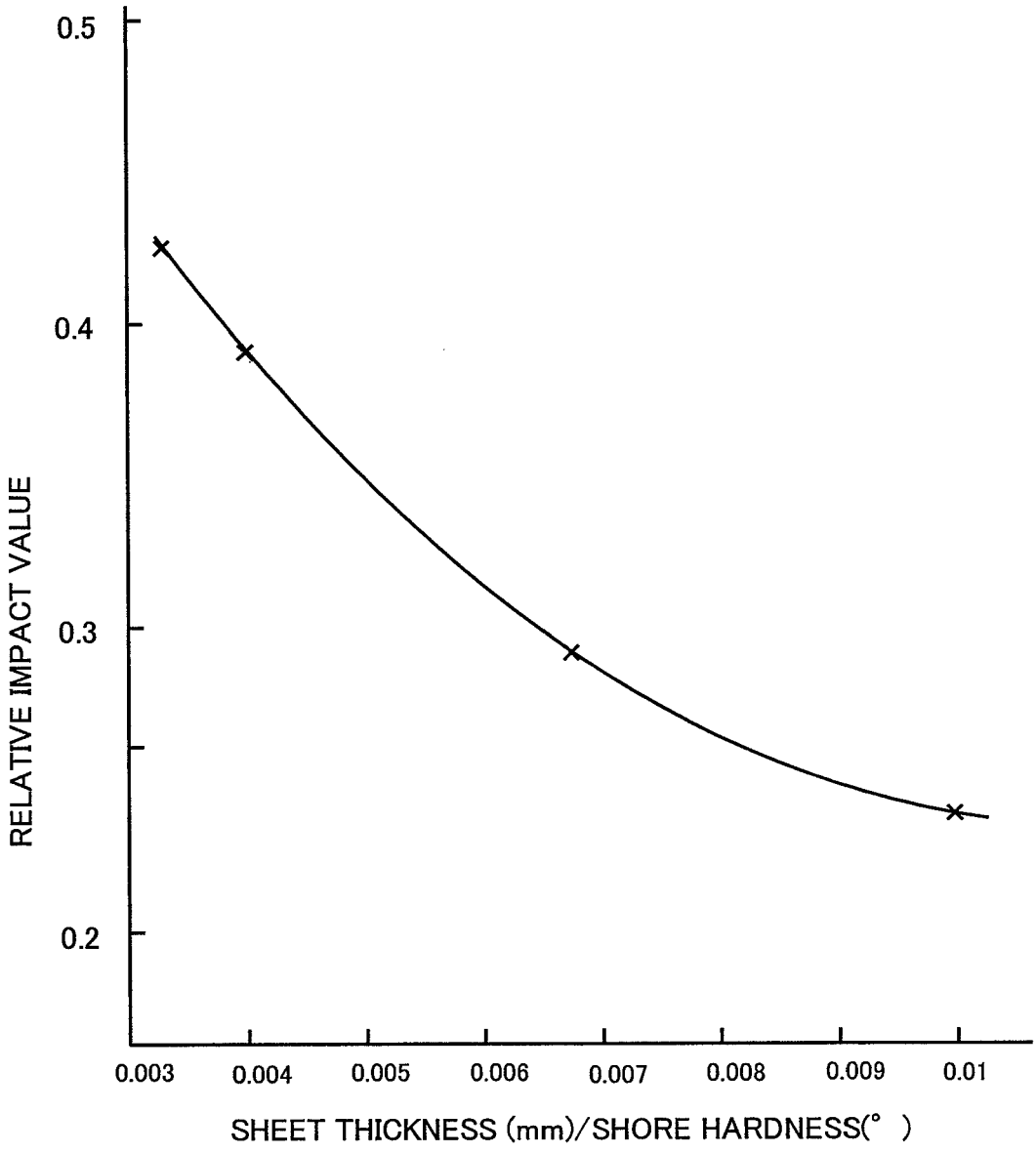
FIG. 6 is a graph showing a characteristic of a relative impact value with respect to the sheet thickness (mm)/shore hardness)(°) of the blind sheet of the flat display device of the embodiment of the present invention.

The relationships between the "sheet thickness (mm)/shore hardness" and the relative impact value are collected from the results of Table 2 to generate Table 3. The results of Table 3 are presented as a graph in FIG. 6.

As can be seen from Table 3, the relationship between the "sheet thickness (mm)/shore hardness)(°)" of the blind sheet serving as an impact attenuation layer and the relative impact value is close to being an inversely proportional relationship. Therefore, in order to make the thickness of the glass of the PDP panel 1.8 mm and to make the relative impact value no more than 0.4, the "sheet thickness (mm)/shore hardness)(°)" of the blind sheet is desirably 0.004 or more. In addition, in order to make the relative impact value no more than 0.29 to adopt glass 1.5 mm thick in the future, the value of the "sheet thickness (mm)/shore hardness)(°)" of the impact attenuation layer is desirably 0.0067 or more. Although it is hard to consider the upper limit of the impact attenuation result, it is expected that, when the sum of the "sheet thickness (mm)/shore hardness)(°)" of each impact attenuation layer has a value exceeding 0.04, a problem where each impact attenuation layer or the whole optical filter is easily deformed on impact will arise. Therefore, the sum of the "sheet thickness (mm)/shore hardness)(°)" of each impact attenuation layer is desirably no more than 0.04.

TABLE 3

| Shore hardness | Sheet thickness | Sheet thickness (mm)/ shore hardness (°) | Relative impact value |
|---|---|---|---|
| 60 | 0.2 | 0.0033 | 0.42 |
| 50 | 0.2 | 0.0040 | 0.39 |
| 30 | 0.2 | 0.0067 | 0.29 |
| 20 | 0.2 | 0.0100 | 0.24 |

When the experimental result mentioned above is applied to the constitution of the optical filter 12 in FIG. 1, the blind sheet 121 is stuck to the surface of a flat display panel 11 via the adhesive member 13 and the blind sheet 121 functions as an impact attenuation layer, and the (sheet thickness (mm)/shore hardness)(°) of the impact attenuation layer is at least 0.004 and less than 0.04 and more preferably at least 0.0067 and less than 0.04.

A silicon resin or acrylic resin is generally employed as the transparent material for the blind sheet. In order to retain physical strength, the shore hardness of the transparent layer of the blind sheet must be set at 20° or more and desirably 20 to 50°. In order to retain physical strength, the shore hardness of the semitranslucent layer of the blind sheet is desirably higher than that of the transparent layer and preferably at 50° or more.

Figure 7:
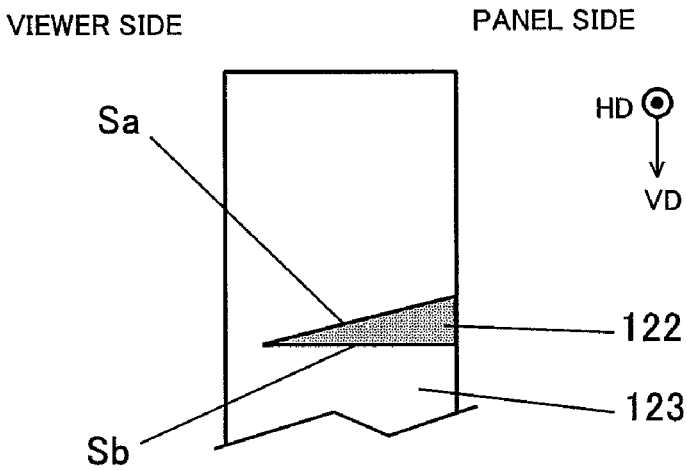
FIG. 7 is a schematic partial enlarged lateral cross-sectional view of the blind sheet of the flat display device of another embodiment of the present invention.

In another embodiment, the cross-section of the blind sheet 121 in the vertical direction of the semitranslucent layer 122 can be a right-angled triangle with a taper in a direction facing the viewer and, as shown in FIG. 7, the upper portion can be an oblique face Sa so that the limiting effect due to external light entering from above is the same and the lower portion can be a horizontal face Sb so that a large amount of light from the display panel can be transmitted and, as a result, the aperture ratio is an improvement on the previous isosceles triangle case and permits a high contrast at brighter points.

Figure 8:
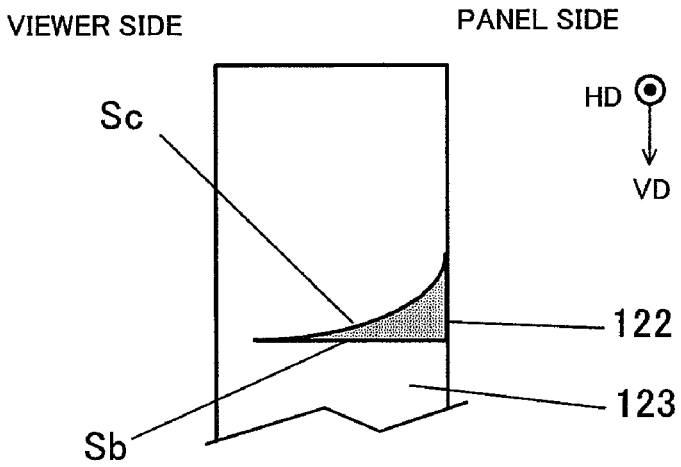
FIG. 8 is a schematic partial enlarged lateral cross-sectional view of the blind sheet of the flat display device of another embodiment of the present invention.
Figure 9:
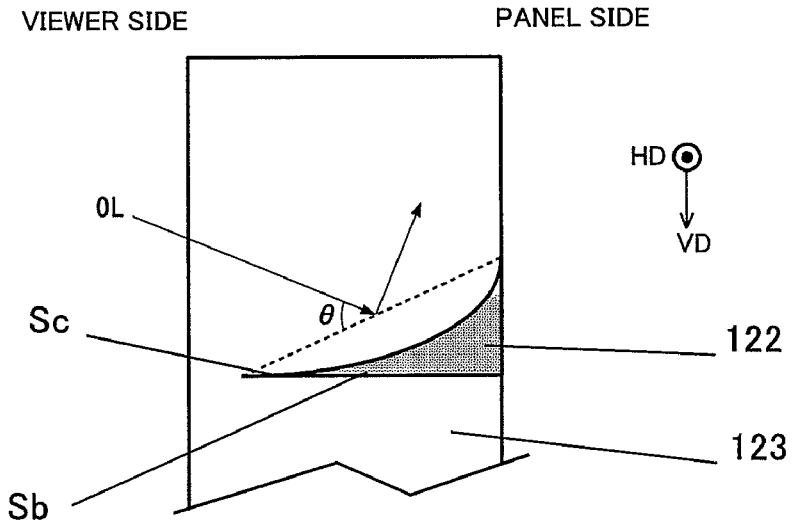
FIG. 9 is a schematic partial enlarged lateral cross-sectional view of the blind sheet of the flat display device of another embodiment of the present invention.
Figure 10:
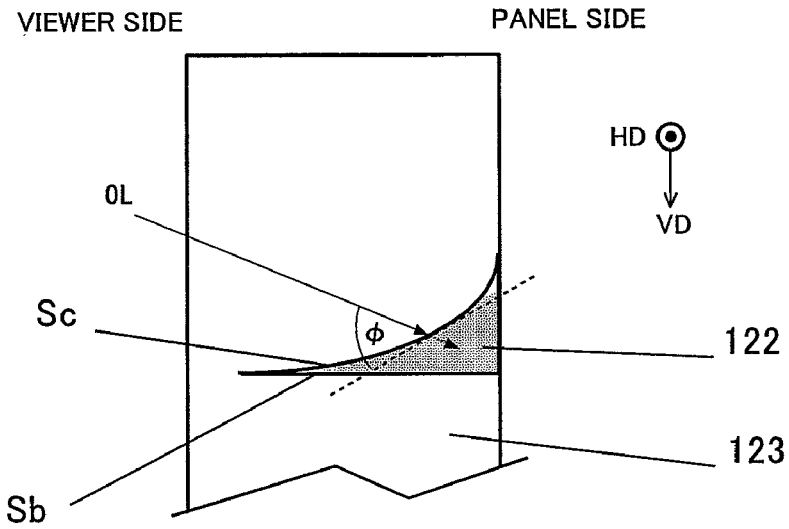
FIG. 10 is a schematic partial enlarged lateral cross-sectional view of the blind sheet of the flat display device of another embodiment of the present invention.

In a further embodiment, the cross-section of the blind sheet 121 in the vertical direction of the semitranslucent layer 122 is a right-angled triangle with a taper in a direction facing the viewer and, by providing curvature so that the oblique face Sc of the semitranslucent layer 122 is concave as shown in FIG. 8, the light of the original reflection as shown in FIG. 9 (the critical angle θ which is the angle at which the external light OL is totally reflected in a case where the upper portion of the oblique face is flat) can be absorbed as shown in FIG. 10 and the apparent critical angle f can be changed, whereby the light incident on the display panel decreases due to reflection and the limiting effect can be improved further. Accordingly, the upper concave portion of the semitranslucent layer 122 is preferably formed so that a tangent, to the horizontal face, of the concave portion of the oblique face Sc of the semitranslucent layer 122 gradually increases moving away from the free end.

Figure 11:
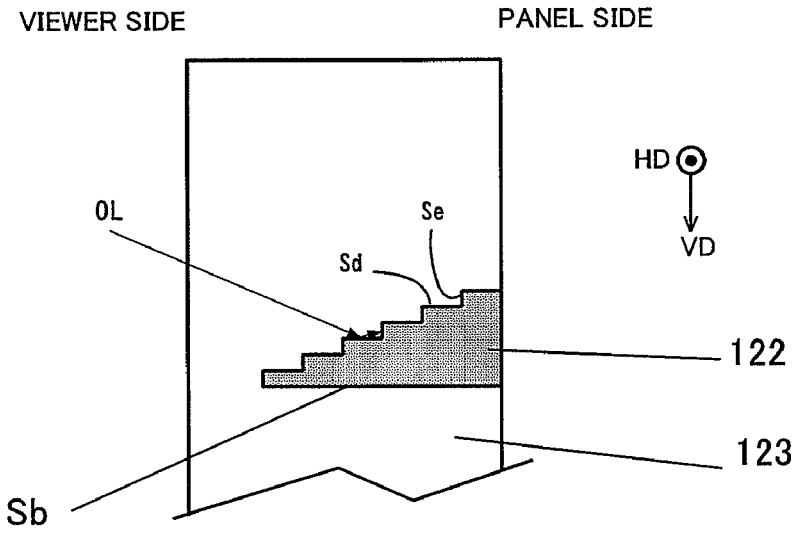
FIG. 11 is a schematic partial enlarged lateral cross-sectional view of the blind sheet of the flat display device of another embodiment of the present invention.
Figure 12:
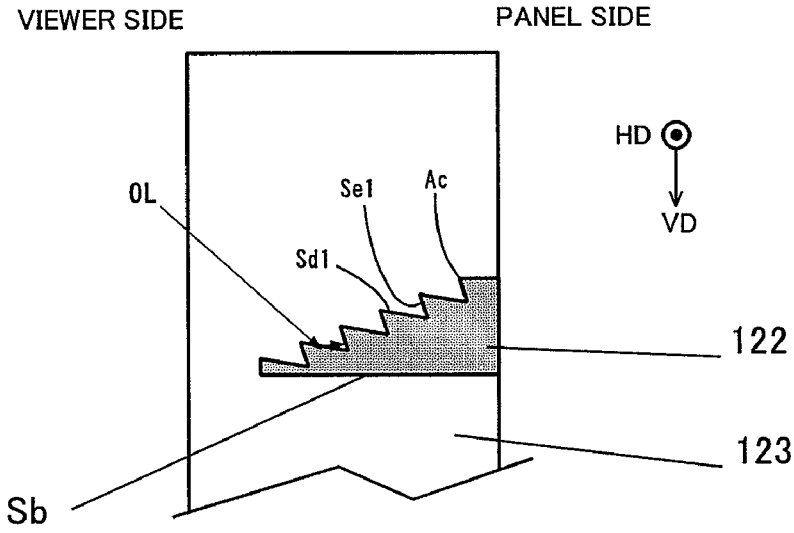
FIG. 12 is a schematic partial enlarged lateral cross-sectional view of the blind sheet of the flat display device of another embodiment of the present invention.

Furthermore, in a further embodiment, the cross-section of the blind sheet 121 in the vertical direction of the semitranslucent layer 122 is an isosceles triangle with a taper in a direction facing the viewer. However, as shown in FIG. 11, by providing steps (Sd, Se) in the upper oblique face of the semitranslucent layer 122, the light reflected by the horizontal face Sd hits and is absorbed by a vertical wall Se and the apparent critical angle, which is the same as the aforementioned critical angle, can be changed, whereby the limiting effect can be improved further. Furthermore, in addition to forming steps (Sd, Se) in the upper oblique face of the semitranslucent layer 122 from only horizontal and vertical faces, the external light limiting effect can be improved further by means of a constitution comprising oblique faces (Sd1, Se1) such that oblique stepped edges form an acute angle. Ac (or an obtuse angle) or by creating a rough face (this may cover the whole of the semitranslucent layer 122), as shown in FIG. 12.

The length and breadth dimensions of the color-tone correcting layer 126 are substantially smaller than those of the electromagnetic wave blocking layer 125 and, as shown in FIG. 1, the perimeter of the electromagnetic wave blocking layer 125 protrudes from the outer edge of the color-tone correcting layer 126 to the outside to expose a metal pattern layer of the electromagnetic wave blocking layer 125 and constitute an earth connection portion. The length and breadth dimensions of the blind sheet 121 and the electromagnetic wave blocking layer 125 are substantially the same.

The optical filter 12 is stuck directly onto the flat display panel 11 by sticking the side of the blind sheet 121 by means of the translucent adhesive member 13.

The adhesive member 13 whereby the optical filter 12 is stuck to the flat display panel 11 is a translucent acrylic-based or silicon-based pressure-sensitive adhesive or bonding adhesive that has a refractive index for which the difference with respect to the respective refractive indices of one or both of the substrates constituting the optical filter 12 or the screen of the flat display panel 11 (a front glass substrate in the case of a plasma display panel) is no more than 0.2, such as a refractive index of 1.4 to 1.6, for example. Thus, if the adhesive member 13 has a refractive index that is substantially equal to the respective refractive indices of the two substrates, reflection at the interface between the adhesive member 13 and the substrates is prevented and the distance from the plasma display panel can be minimized and fixed. It is accordingly possible to secure a wide viewing angle with little bending.

The flat display panel 11, which has the optical filter 12 stuck to the screen thereof, is held by a chassis (not shown).

The flat display device is obtained by directly sticking the optical filter 12 to the screen of the flat display panel 11. Hence, there is no reflection (approximately eight percent) of the light emitted by the flat display panel 11, which is generated in cases where an air layer is formed between the flat display panel and the optical filter 12, and deterioration of the contrast (at particularly bright points) due to an improvement in the luminance and due to the reflection of reflected light onto non-light-emitting parts can be prevented.

Directly sticking a blind sheet onto the display panel means that there is no reflection caused by the air layer and the distance between the light emission face and the semitranslucent layer is minimized and fixed and the following various effects are exhibited.

For example, in cases where there is a distance between the screen and the blind sheet 121, the semitranslucent layer generates light reflection and therefore the light emitted by the screen spreads over a wider range if there is a distance between the screen and the blind sheet, and the same emitted light is reflected by a plurality of semitranslucent layers, whereby ghosting is produced. In addition, in cases where the panel and blind sheet are fixed via a structure, a difference in the distance between the screen and the blind sheet is generated as a result of inconsistencies in the mounting of parts above and below the screen. This difference is particularly prominent in the case of a large screen such as a plasma display panel. Due to the difference above and below the screen, a difference in the luminance of the screen and a viewing angle difference or the like is generated. However, the problems mentioned above can be improved and the image quality enhanced through direct fixation using the pressure-sensitive material of the embodiment.

In cases where an air layer is formed between the flat display panel and the optical filter 12, for example, approximately eight percent of the light generated by the flat display panel is generally reflected by the respective interfaces of the flat display panel and the optical filter 12 facing the air layer and returns inside the panel. However, the returning light is diffused reflection light and there is therefore the risk of also illuminating non-light-emitting parts adjacent to the light-emitting parts of the panel and of generating ghosts. However, the direct adhesion-type constitution of the embodiment is able to suppress the generation of ghosts.

In the case of a plasma display panel in particular, a fluorescent layer is formed in the panel and the reflectance of the fluorescent layer is on the order of approximately thirty percent. Hence, the returning light (the light reflected by the interface of the flat display panel or optical filter 12) is reflected by the fluorescent layer, and it can be seen that light is also emitted by the non-light-emitting parts and the outline of the light-emitting parts is blurred, meaning that there is a risk of losing the impact of the displayed image.

Furthermore, although attempts have been made in recent years to reduce black luminance in a flat display panel, there is a risk that the black luminance reduction effect will be diminished by the influence of the reflection of the returning light. The influence of the reflection of the returning light is even greater in a case where the provision of the blind sheet 121 and the suppression of black sharp luminance, which suppresses external light reflection, are combined in particular.

The interfaces of the flat display panel 11 and optical filter 12 of the flat display device are stuck together by the adhesive member 13, which has a refractive index for which the difference with respect to the refractive indices of the flat display panel 11 and optical filter 12 is no more than 0.2, whereby reflection at these interfaces is suppressed, the impact of the image is prevented from being lost, and a decrease in the effect of reducing the black luminance of the flat display panel for which a black luminance reduction is sought is prevented.

The effect of preventing a reduction of the impact of the image and of preventing a decrease in the rate of black luminance reduction is made even greater in cases where the flat display panel 11 is a plasma display panel by performing discharge drive control to weaken the intensity of a single discharge and reduce the number of discharges so that the luminance of a discharge other than a display discharge that performs light emission for image formation (for example, a pre-discharge such as a reset discharge, priming discharge, or address discharge that is not directly related to a display) is no more than 1 cd/m2.

In addition, the flat display device employs an acrylic-based or silicon-based adhesive member 13 and the adhesive power when the adhesive member 13 is actually applied to a product is 3N/inch to 30N/inch with vertical peeling twenty-four hours after sticking. As a result, the base material of the flat display panel 11 and optical filter 12 can be peeled without being damaged during repairs and cannot be peeled in a commercial environment. The adhesive power is desirably 3N/inch to 13N/inch when the peeling efficiency during factory repairs is considered. A vertical peeling adhesive power of 3N/inch, for example, means that a 1-inch-wide optical filter 12 is stuck to the flat display panel 11 via the adhesive member 13 over the whole surface of the optical filter 12 and that the force required when the optical filter 12 is peeled in a vertical direction to the flat display panel 11 is 3N.

In addition, the impact characteristic with respect to impacts from the outside can be retained and cracks in the flat display panel can be prevented by establishing the thickness of the optical filter 12 (in the direction of the normal from the screen), in addition to the thickness of the adhesive member 13, as 0.5 mm or more.

Furthermore, by sticking the electromagnetic wave blocking layer 125 and the blind sheet 121 of the optical filter 12 on the side of the flat display panel 11, a relatively stable shield member is interposed between the color-tone correcting layer 126 comprising a dye which readily deteriorates under the effects of heat and light and the flat display panel 11, whereby the influence of heat and light from the flat display panel 11 on the color-tone correcting layer 126 can be attenuated.

Moire or other visual references can be attenuated by providing a filter member for reducing transmittance on the viewer side of the electromagnetic wave blocking layer 125 and blind sheet 121. Inconsistencies in the blackening of the electromagnetic wave blocking layer 125 and Moire or other visual references generated between the electromagnetic wave blocking layer 125 and the blind sheet 121 and flat display panel 11 can be further attenuated.

In addition, by forming the electromagnetic wave blocking layer 125 of the optical filter 12 substantially larger than the color-tone correcting layer 126 and the blind sheet 121 which are formed on the electromagnetic wave blocking layer 125 and allowing the outer perimeter of the electromagnetic wave blocking layer 125 to protrude from the outer perimeter of the color-tone correcting layer 126 and the blind sheet 121, the electromagnetic wave blocking layer 125 can be easily connected to earth.

Furthermore, by employing a shore hardness for the transparent layer of the blind sheet of the flat display device of no more than 50°, impact forces from the outside can be absorbed and attenuated.

The order in which the electromagnetic wave blocking layer, color-tone correcting layer and blind sheet of the optical filter are stacked in the above mentioned embodiment is not limited to the example of FIG. 1. The optical filter may also be constituted such that the blind sheet and electromagnetic wave blocking layer are stacked with their positions switched, for example.

Figure 13:
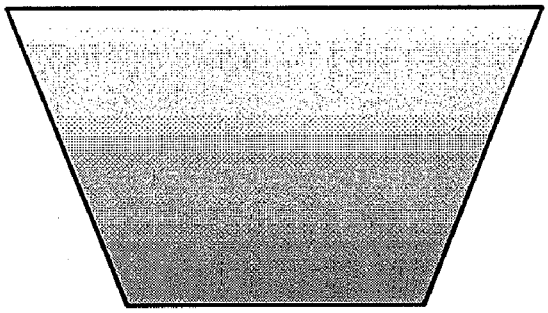
FIG. 13 is a diagrammatic drawing of an aspect in a case where a screen is viewed at an inclination of 45 degrees to a flat display device that comprises the blind sheet of the present invention.
Figure 14:
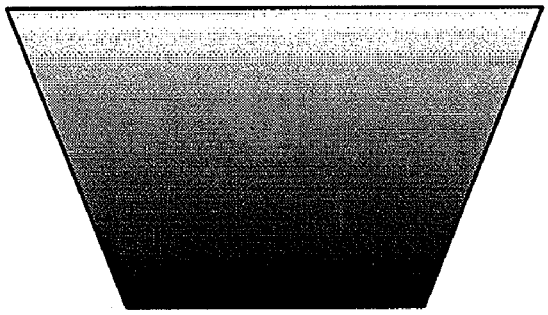
FIG. 14 is a diagrammatical drawing of an aspect in a case where a screen is viewed at an inclination of 45 degrees to a display panel which is equipped with a sheet with a conventional black horizontal louver structure.

Finally, in a case where an optical filter comprising a blind sheet of the kind shown in FIG. 1 for which the ratio of the transmittance of the viewing angle at the center of the screen with respect to the transmittance at the normal to the center of the screen is 0.12 is created and stuck using an adhesive member to the front of the display face of the plasma display panel and where the screen is viewed with a slope of 45 degrees, the effect of the shadow of the plurality of semitranslucent layers is reduced and the image of the lower half of the screen can be seen, as shown in FIG. 13.

Although an adhesive member is used to stick an optical filter to the front face of the display face of the display device in the embodiment mentioned above, it is possible to provide a display device that is capable of preventing the reflection of external light and securing a vertical screen viewing angle even in cases where the optical filter of the present invention is disposed at the front face of the display face of the display device spaced apart from the display face. The present invention also includes the constitution of the optical filter itself.

The invention claimed is:

1. A display device having a plasma display panel, comprising:

an optical filter having a blind sheet that comprises a plurality of semitranslucent layers having translucence arranged side-by-side and each extending in a horizontal direction and each having a taper whose thickness that decreases as the distance from the plasma display panel increases, and a plurality of transparent layers each being disposed between the semitranslucent layers and each being of a higher translucency than that of the semitranslucent layer and of a greater thickness than the thickness of the semitranslucent layer; and an adhesive member for sticking the optical filter to the plasma display panel, wherein a ratio of transmittance at a screen limit angle with respect to transmittance of the optical filter at a center of the plasma display panel is at least 0.10 and not more than 0.50, wherein the optical filter further has an electromagnetic wave blocking layer laminated on the transparent layers of the blind sheet and a color-tone correcting layer laminated on the electromagnetic wave blocking layer.

2. The display device according to claim 1, wherein the adhesive member has a refractive index that is substantially equal to that of a glass substrate constituting the plasma display panel.

3. The display device according to claim 1, wherein a black coating film is formed on the semitranslucent layer at the interface thereof.

4. The display device according to claim 1, wherein the shore hardness of the transparent layer is 20° to 60°.

5. The display device according to claim 1, wherein the shore hardness of the transparent layer is equal to or less than the shore hardness of the semitranslucent layer.

6. The display device according to claim 1, wherein the semitranslucent layer is formed so as to be embedded and terminated in material of the transparent layer.

7. The display device according to claim 1, wherein the upper portion of the semitranslucent layer comprises an oblique face, and the lower portion of the semitranslucent layer comprises a horizontal face.

8. The display device according to claim 7, wherein the upper portion of the semitranslucent layer is provided with curvature to create a concave portion in the oblique face of the upper portion of the semitranslucent layer.

9. The display device according to claim 1, wherein steps are provided in the oblique face of the upper portion of the semitranslucent layer, or above and below the semitranslucent layer.

10. The display device according to claim 1, wherein the blind sheet is stuck to the plasma display panel via the adhesive member, the blind sheet functions as an impact attenuation layer, and (sheet thickness (mm)/shore hardness (°)) of the blind sheet is at least 0.004 and less than 0.04.

* * * * *